US005218727A

United States Patent [19]

Krumbeck

[11] Patent Number: 5,218,727

[45] Date of Patent: Jun. 15, 1993

[54] ABOVE GROUND SPA LIFT FOR THE HANDICAPPED

[75] Inventor: Keith Krumbeck, Missoula, Mont.

[73] Assignee: Industrial Design & Mfg., Inc., Missoula, Mont.

[21] Appl. No.: 842,010

[22] Filed: Feb. 26, 1992

[51] Int. Cl.[5] ..... E04H 4/14; A47K 3/12

[52] U.S. Cl. ..... 4/563.1; 4/496; 414/921

[58] Field of Search ..... 4/496, 559, 560.1, 561.1, 4/562.1, 563.1; 297/DIG. 10; 414/543, 744.3, 921

[56] References Cited

U.S. PATENT DOCUMENTS

| | | | |
|---|---|---|---|
| 3,371,357 | 3/1968 | Berthelsen et al. | 4/563.1 |
| 3,815,163 | 6/1974 | Sullivan | 4/562.1 |
| 3,918,108 | 11/1975 | Feyerherm | 4/563.1 |
| 3,994,030 | 11/1976 | Cassell et al. | 4/563.1 |
| 4,141,089 | 2/1979 | Krumbeck | 4/496 |
| 4,221,008 | 9/1980 | Nolan | 4/496 |
| 4,283,803 | 8/1981 | Krumbeck | 4/496 |
| 4,885,810 | 12/1989 | Unger et al. | 4/496 |
| 4,941,216 | 7/1990 | Boublil | 4/496 |
| 4,996,728 | 3/1991 | Nolan | 4/496 |
| 5,146,638 | 9/1992 | Richards | 4/562.1 |

FOREIGN PATENT DOCUMENTS

| | | | |
|---|---|---|---|
| 2007570 | 4/1978 | Fed. Rep. of Germany | 4/562.1 |
| 3511267 | 10/1986 | Fed. Rep. of Germany | 4/562.1 |
| 2197636 | 5/1988 | United Kingdom | 4/561.1 |

*Primary Examiner*—William A. Cuchlinski, Jr.
*Assistant Examiner*—John L. Beres
*Attorney, Agent, or Firm*—Volpe & Koenig

[57] ABSTRACT

A lift apparatus for an above ground spa or pool to enable a handicapped or infirm person access to and egress from the spa or pool without the need for an attendant to assist them. The lift comprises an upright base securely mounted adjacent to one wall of the above ground spa. The base supports a lift arm assembly having a seat mounted thereon. Lift and rotate controls are provided to permit the seat occupant to raise the seat to a fully elevated position above the wall of the spa, to swing the seat and occupant across the wall and to lower the seat to a desired height within the spa. The lift arm is powered by water driven hydraulics which are configured such that the seat can only be pivoted when it is in its fully elevated position above the wall of the spa.

7 Claims, 3 Drawing Sheets

ABOVE GROUND SPA LIFT FOR THE HANDICAPPED

This invention relates to a lift apparatus to permit a handicapped or infirm person access to and egress from an above ground spa or pool without an attendant.

BACKGROUND OF THE INVENTION

It is well known that many aquatic activities are extremely desirable forms of physical therapy for handicapped persons. However, in the past, handicapped or infirm individuals confined to wheelchairs have had great difficulty getting into and out of spas and swimming pools.

A variety of lift apparatus have been devised to assist handicapped and infirm persons in this regard. One such apparatus is disclosed in my U.S. Pat. No. 4,141,089. That patent discloses a swimming pool lift apparatus which permits a person confined to a wheelchair to be raised and lowered into a swimming pool within the wheelchair.

A number of other apparatus have been designed to enable handicapped or infirm persons access to pools and spas. However, generally these apparatus require the assistance by an attendant for the handicapped or infirm person to gain access to the pool or spa. In particular, with respect to above ground spas and/or pools, lift devices have been devised to elevate a person above the wall of a spa or pool and, thereafter, the person is manually swung over the pool or spa and lowered in. There are a number of drawbacks with such existing lift apparatus which have been recognized and sought to be remedied by the present invention.

SUMMARY AND OBJECTS OF THE INVENTION

A lift apparatus for an above ground spa or pool is provided to enable a handicapped or infirm person access to and egress from the spa or pool without the need for an attendant to assist them. The lift comprises an upright base securely mounted adjacent to one wall of the above ground spa. The base supports a lift arm assembly having a seat mounted thereon. Lift and rotate controls are provided to permit the seat occupant to raise the seat to a fully elevated position above the wall of the spa, to swing the seat and occupant across the wall and to lower the seat to a desired height within the spa.

The lift arm is powered by water driven hydraulics which are configured such that the seat can only be pivoted when it is in its fully elevated position above the wall of the spa. Preferably, the lift arm is powered by an external water pressure source for upward and pivotal displacement and utilizes gravity for the downward displacement of the lift arm. The hydraulic system is designed to operate in a range of 30–60 PSI which accommodates normal household water pressure. The lift apparatus requires no electrical or other power sources which may create a hazard proximate a spa or pool.

It is an object of present invention to provide a lift for handicapped or infirm persons which is individually operable to permit unassisted access to and egress from an above ground pool or spa.

It is a further object of the invention to provide such a lift which permits pivotal movement of the lift seat at a desired elevated location and does not permit unwanted pivotal movement when the lift is being operated to raise or lower the lift seat.

It is a further object of the invention to provide such a lift which is powered by pressurized water to avoid hazards in the spa or pool area.

Other objects and advantages of the invention will become apparent from the description of a presently preferred embodiment set forth below.

DETAILED DESCRIPTION OF A PREFERRED EMBODIMENT

Figure 1:
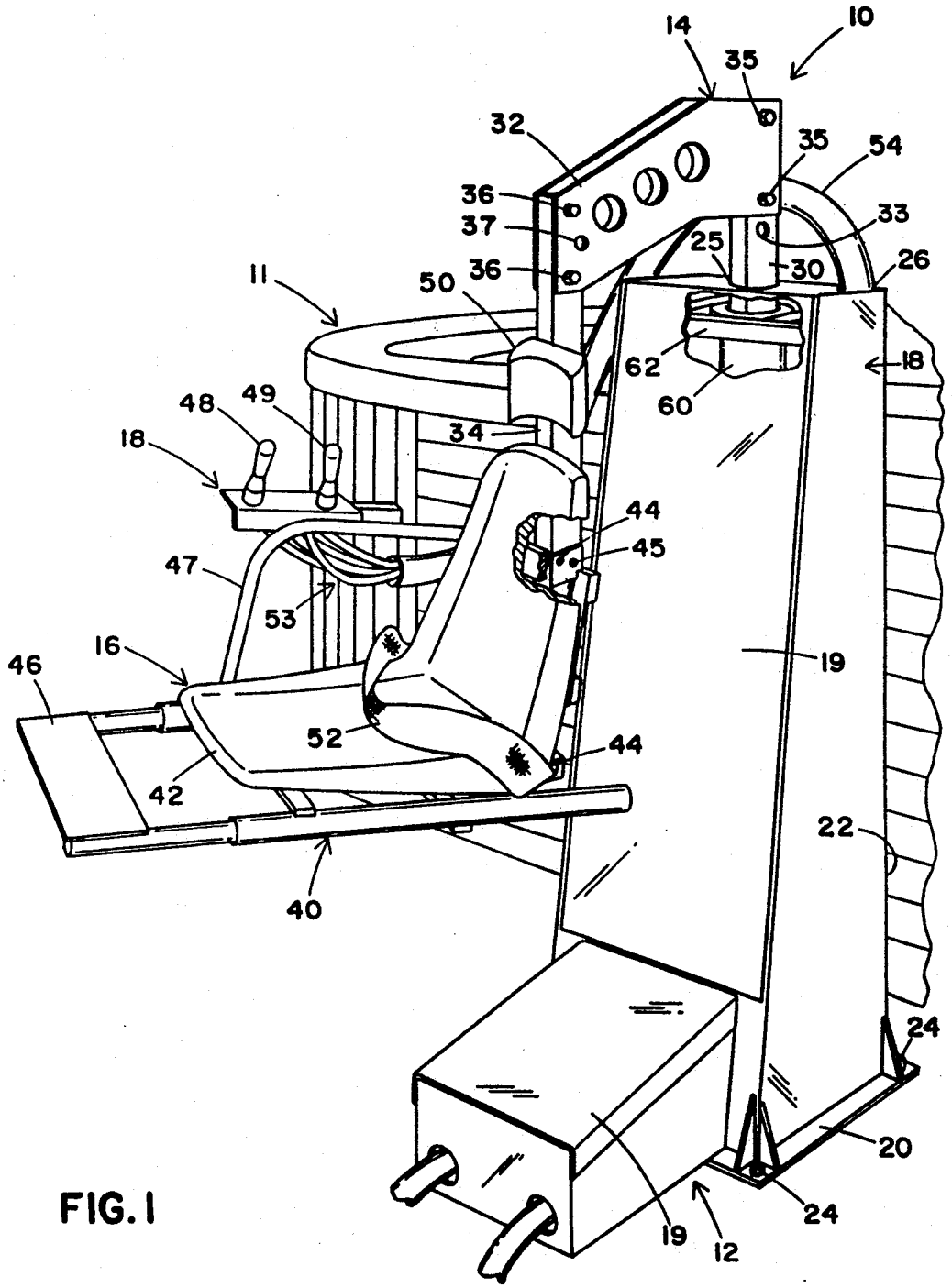
FIG. 1 is a perspective view of a lift apparatus made in accordance with the teachings of the present invention.

With reference to FIG. 1, there is shown a lift apparatus 10 which is generally comprised of a base 12, a lift arm assembly 14, associated seat assembly 16 and hydraulic controls 18. A typical above ground spa 11 with which lift apparatus 10 is used is illustrated behind the lift apparatus.

The lift base 12 includes a housing 18 having a base plate 20 with three upright housing walls which house the hydraulic power system. Access panels 19 are provided to cover the front of the housing 18 and to permit access to the hydraulics. The rear housing wall 22 is perpendicular to the base plate 20 so that the lift base 12 may be securely mounted flush with or in close proximity to the spa 11 with which the lift apparatus 10 is to be used. To install the lift 10 for use, the base plate 20 of the housing is securely fastened by bolts 24 or other means to the deck or floor immediately adjacent the spa 11.

Preferably, the housing 18 is made of stainless steel to avoid corrosion. The top of the housing 18 contains two openings 25, 26, one for the lift arm assembly 14 and the second for the hydraulic lines.

The lift arm assembly 14 comprises an upright piston rod portion 30, a substantially horizontal swing arm portion 32 and a substantially upright support arm portion 34. The piston rod 30 is rigidly connected to the swing arm 32 by two bolts 35 in a fixed position. Additional bolt receiving apertures 33 (only one shown) are provided for height adjustment.

The support arm 34 is also rigidly attached to the opposite end of the swing arm 32 with the use of two bolts 36. However, an additional bolt receiving aperture 37 is defined in the swing arm 32 to permit adjustment in the angle of the support arm 34 to accommodate a variety of differently shaped pool and/or spa walls.

The seat assembly includes a frame 40, to which a seat 42 is rigidly secured. The frame is attached to the support arm 34 via bolts 44. An additional bolt receiving aperture 45 is provided in the seat frame 40 to adjust the seat to a level position when the support arm 34 is affixed to the swing arm 32 in its alternate angled position utilizing aperture 37.

Preferably, the seat frame 40 includes a leg support 46 which telescopes outwardly from the seat 42 to support the user's legs after the user has become seated in the seat 42 and before operation of the lift. The leg support 46 assures that the user's legs clear the wall of the spa 11 during the pivotal displacement of the seat 42 over the spa wall.

Preferably, the seat frame 40 has one arm 47 which permits easy access to the seat 42 from the opposite side. The hydraulic controls 18 are mounted on the arm 47, one control 48 being provided to control vertical displacement, a second control 49 being provided to control pivotal displacement of the lift arm and seat assemblies 14, 16.

For comfort and safety, a headrest 50 is provided which is secured to the support arm 34. A seat belt 52 is also provided for the seat 42.

The two controls 48, 49 operate hydraulic valves with which a plurality of hydraulic lines 53 are associated. To protect and contain the hydraulic lines 53 outside the housing 18, a flexible sheath 54 is provided which extends from the top of the housing 18 to proximate the hydraulic controls 48, 49.

Figure 2:
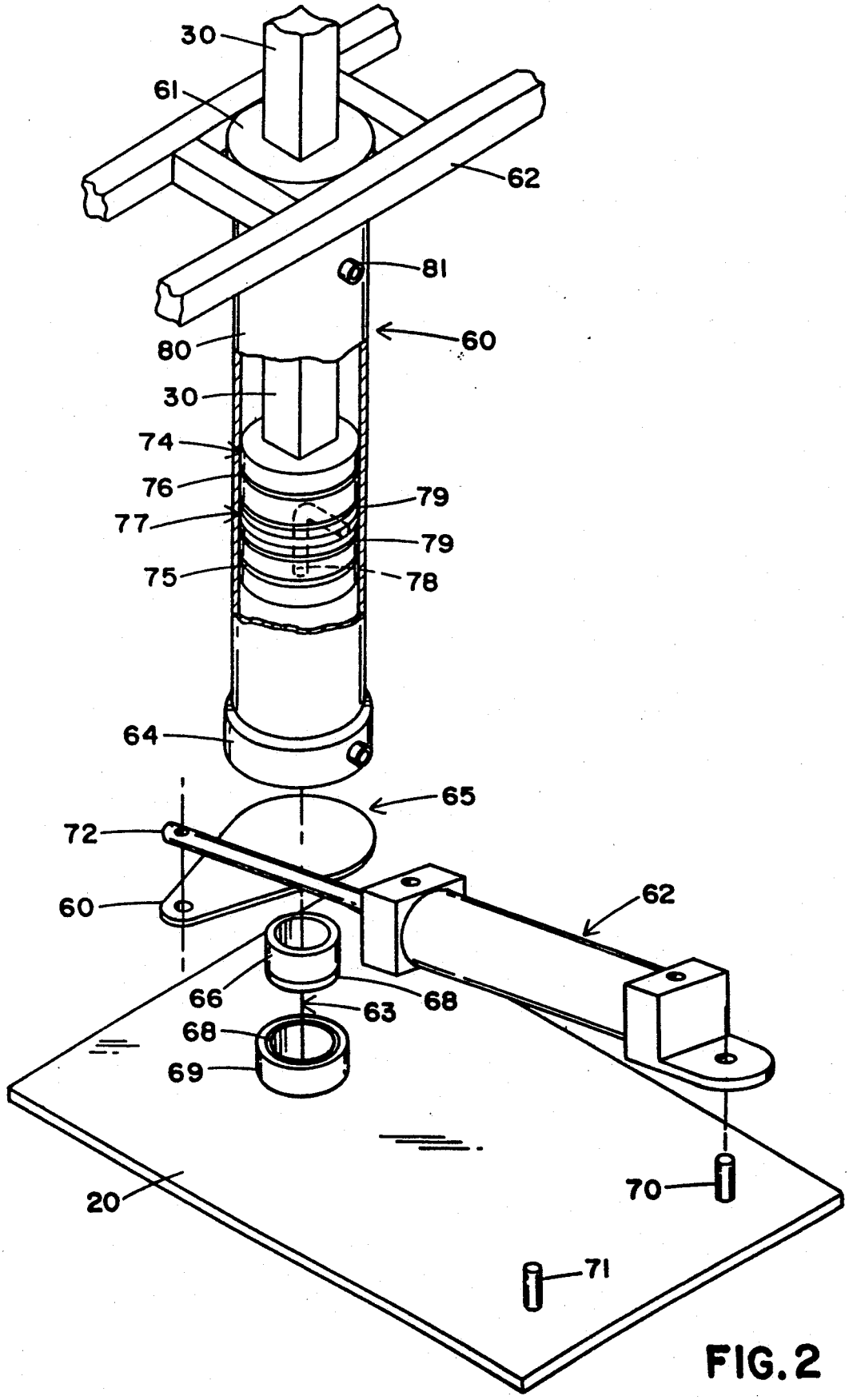
FIG. 2 is a partially exploded view of the internal hydraulic cylinders which power the lift apparatus shown in FIG. 1.

As best shown in FIG. 2, displacement of the lift arm and associated seat assemblies 14, 16 is effected by primary and secondary water powered cylinders 60, 62. The main cylinder 60 is mounted upright in the center of the housing 18 for pivotal displacement about a vertical axis 63. The top end 61 of the main cylinder 60 is mounted via a retaining bracket 62. The bottom end 64 of the main cylinder 60 is affixed to a plate 65 which includes a depending boss 66 aligned with the vertical axis of the main cylinder 60 and a horizontally projecting portion 67. The boss 66 is received within a cylindrical receptacle 69 defined in the center of housing base 20 to pivotally mount the bottom end of the main cylinder 60. Solid bearing pads 68 are provided for the bottom of the boss 66 and interior of the cylindrical receptacle 69.

The secondary cylinder is 62 is pivotally mounted on one end to one of two pins 70, 71 projecting from the base 20 of the housing 18. The piston rod 72 of the secondary cylinder 62 is pivotally mounted to the horizontally projecting portion 67 of the plate 65 affixed to the bottom of the main cylinder 60. The pivotal joint of the end of piston rod 72 is preferably about 13 inches from the pivot axis of the main cylinder 60. When the piston rod 72 of secondary cylinder 62 is extended, the lift arm and seat assemblies 14, 16 are pivoted over top of the spa; when piston rod 72 is retracted, the lift arm and seat assemblies 14, 16 are pivotally displaced to outside of the spa. To effect clockwise pivotal movement of the lift arm and seat assemblies over top of the spa, the secondary cylinder 62 is pivotally mounted on right side pin 70 with the horizontally projecting portion 67 of the main cylinder plate 65 positioned toward the left side of the main cylinder pivotal axis 63. Alternatively, where counterclockwise rotation of the lift arm and seat assemblies over top of the spa is desired, the secondary cylinder 62 is pivotally mounted on left side pin 71 and the horizontally projecting portion 67 of the main cylinder plate 65 is directed towards the right hand side of the pivot axis of the main cylinder 60. The connection of the secondary cylinder 62 to effect clockwise or counterclockwise pivotal displacement of the lift arm and seat assemblies is determined on an individual basis when the lift apparatus 10 is installed.

Preferably, the vertical displacement of the main cylinder 60 from a fully retracted position to a fully extended position is 25 inches. This permits the seat to be raised from a fully lowered position approximately 18 inches above the ground to clear the wall of a typical spa which is generally no greater than 38 inches high. An initial seat height of 18 inches facilitates the transfer of an individual between a wheelchair and the lift seat 42.

Preferably, the displacement of the secondary cylinder 62 between fully retracted and fully extended positions is 12 inches which permits a rotation of the lift arm through an arc of 125 degrees. Bearings are preferably polyolefin, nylon or other material which does not require the use of contaminating oils.

In operation, both the primary and secondary cylinders 60, 62 are disposed in their fully retracted position which defines a fully lowered seat position outside the spa. The primary cylinder 60 is activated to fully extend piston rod 30 to raise the seat 42 to a fully elevated position. The secondary cylinder 62 is then activated to fully extend piston rod 72 to pivot the lift seat 42 to an over spa position. Thereafter, the primary cylinder piston rod 30 is retracted to return the lift seat 42 to its fully lowered position within the spa. The operations are reversed to permit the user egress from within the spa.

The piston rod 30 of the primary hydraulic cylinder 60 has a generally rectangular cross-section. This prevents unwanted rotational displacement of the piston rod 30 and accordingly, the lift seat 42 as the main cylinder 60 is operated to raise and lower the seat. Pivotal displacement of the lift seat 42 is only permitted when the entire primary cylinder 60 is rotated. Such displacement is controlled by the secondary cylinder 62.

In order to permit pivotal rotation of the lift seat 42 only in its fully elevated position, the secondary cylinder 62 is only operational when the primary cylinder 60 is in its fully extended position. To achieve this operational control of the secondary cylinder 62, the piston 74 of the primary cylinder 60 is selectively configured. In addition to the customary, primary and secondary pressure rings 75, 76, the piston 74 includes a circumferential, medial groove 77 which communicates via a duct 78 defined through the piston 74 with the hydraulic fluid, in this case water, which powers the primary cylinder 60. Grooves and associated "O" rings 79 are provided proximate the hydraulic groove 77 on opposing sides. The primary cylinder wall 80 includes a selectively positioned port 81 such that when the piston 74 reaches it fully extended position, the hydraulic groove 77 defined in the piston 74 is in communication with the port 81 defined in the cylinder wall 80. As discussed in more detail below, the hydraulic line which powers the secondary cylinder 62 is connected to the selectively placed port 81 in the main cylinder wall 80.

Figure 3:
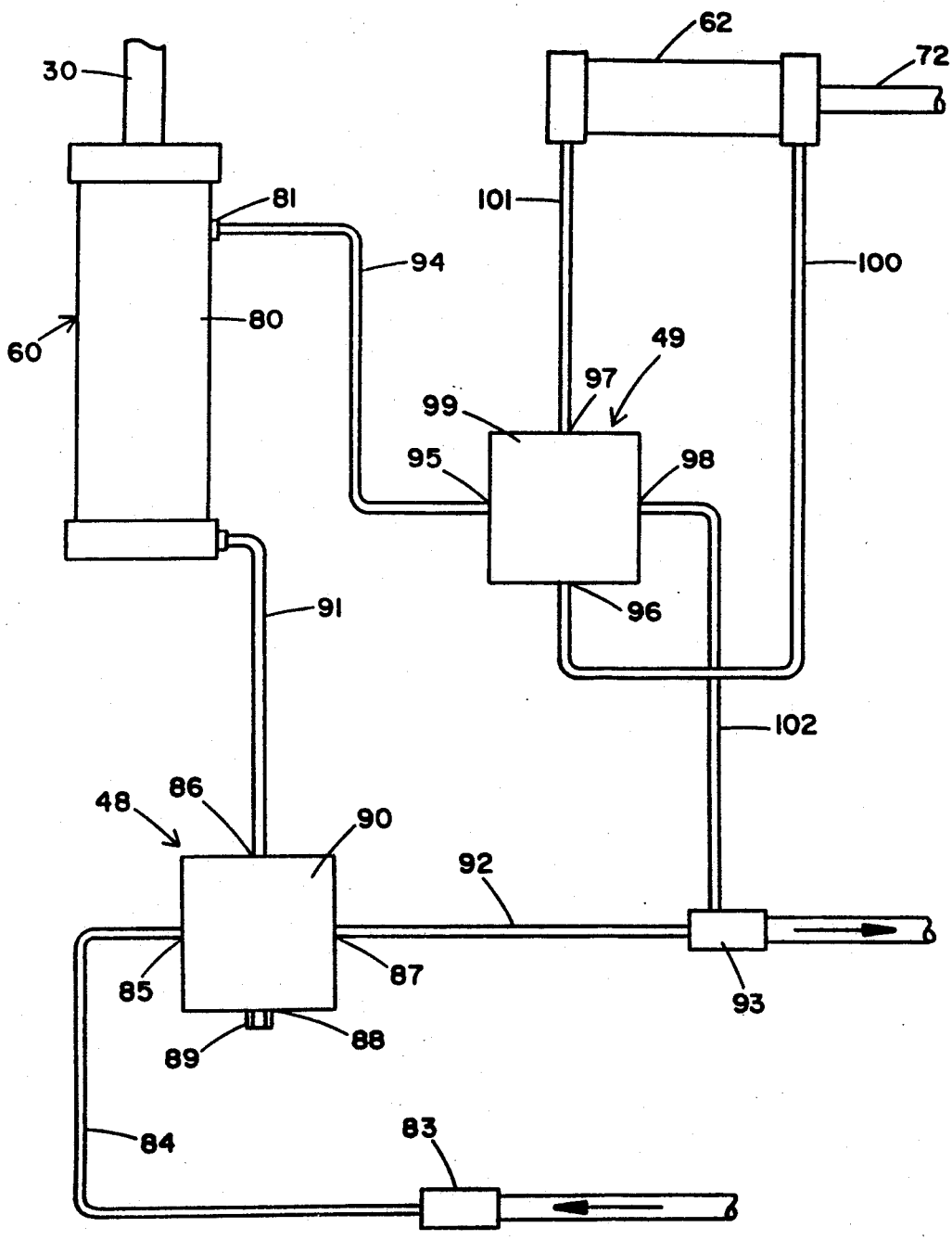
FIG. 3 is a schematic diagram of the water powered hydraulic system of the lift apparatus shown in FIG. 1.

The operation of the hydraulics is best understood with reference to FIG. 3. A source of pressurized water, such as via a garden hose from an outside house tap, is provided by the user and is coupled to an inlet port 83. The pressurized water is communicated directly from inlet port 83 via feed line 84 to a port 85 of a valve 90 of the vertical control 48. A main cylinder feed line 91 is connected to a port 86 of the vertical control valve 90. A main exhaust line 92 is connected to a third port 87 of the vertical control valve 90. A fourth port 88 of valve 90 is blocked via a plug 89.

The vertical control 48 is operable between a raise position where port 85 communicates with port 86 and port 87 communicates with port 88 in valve 90 to a lower position where port 85 communicates with port 88 and port 86 communicates with port 87 of valve 90. When disposed between the raise and lower positions, the ports 85, 86, 87 and 88 do not communicate with each other within valve 90. Accordingly, when the vertical control is operated to its raise position, pressurized water from line 84 travels through the main feed line 91 to the main cylinder 60 forcing the piston 74 upwardly thereby elevating the seat 42. When the vertical control is operated to its lower position, the gravitational load bearing upon piston 74 forces the water contained within primary cylinder outward through feed line 91, valve 90 and main exhaust line 92 to an outlet port 93.

When the piston 74 reaches its furthest upward position, the seat 42 is disposed in its fully elevated position. At this point, the hydraulic groove 77 defined within the piston 74 is in communication with the port 81 defined within the wall 80 of the primary cylinder 60 to which a secondary piston hydraulic feed line 94 is coupled. The opposite end of the secondary feed line 94 is coupled to a port 95 of a valve 99 associated with the rotational control 49. The valve 99 has three other ports 96, 97, 98 to which are coupled a secondary piston retract line 100, a secondary piston extend line 101 and a secondary piston exhaust line 102, respectively. The valve 99 is operable between extend and retract positions. In the extend position, ports 95 and 96 are in communication to provide pressurized water from feed line 94 to the secondary cylinder 62 via line 100 to retract piston rod 72 and ports 97 and 98 are in communication to permit the water to be exhausted from the secondary cylinder 62 via lines 101, 102 to outlet port 93. In the retract position, ports 95 and 97 are in communication to permit pressurized water from feed line 94 to the secondary cylinder 62 via line 101 to extend the piston rod 72 and ports 96 and 98 are in communication to permit water to be exhausted from the secondary cylinder 62 via lines 100, 102. When the valve 99 is maintained between these two positions, there is no communication between the ports 95, 96, 97, 98 and the piston rod 72 is maintained immobile.

Additionally, when the piston 74 of the main cylinder 60 is displaced from its upper most position, no pressurized water is provided to the secondary piston feed line 94. Accordingly, rotational operation via the secondary cylinder 62 is permitted only when the primary cylinder 60 is fully extended.

Preferably, tubing 0.5 inches in diameter is used for hydraulic lines 84, 91 and 92 to provide sufficient thrust within primary cylinder 60 at hydraulic pressures between 30 to 60 PSI, and to permit sufficient exhaust capacity for the gravitational retraction of the primary cylinder 60. Hydraulic lines 94, 100, 101, 102 associated with the secondary cylinder are preferably 0.375 inches in diameter which provides sufficient power to the secondary cylinder 62.

The hydraulic groove 77 defined within piston 74 is preferably bevelled and at least 0.25 inches wide and 0.25 inches deep. The circumferential groove 77 has proved to be better able to communicate sufficient pressurized water to port 81 defined in cylinder wall 80 than merely aligning the end of conduit 78 with port 81. It is necessary that sufficient pressure be provided to line 94 in order to operate secondary cylinder 62. With the use of a water hydraulic system, there is no danger of contamination of the spa or pool.

What I claim is:

1. A lift apparatus for permitting a handicapped or infirm individual access to and egress from an above ground pool or spa without an attendant comprising:

an upright base;

a lift arm assembly having an associated lift seat;

said lift arm assembly mounted to said base for both vertical displacement and pivotal displacement about a vertical pivot axis;

said vertical displacement sufficient to enable the lift seat to be vertically displaced between a fully lowered position whereat the lift seat is disposed at a convenient height for transfer of an individual between a wheelchair and the lift seat, and a fully elevated position whereat the lift seat is disposed at a height sufficient to clear the wall of a spa with which the lift apparatus is used;

said pivotal displacement sufficient to enable the lift seat to be pivoted between an over-spa position and an outside-spa position;

first water powered means disposed within said base to effect said vertical displacement;

second water powered means disposed within said base to effect said pivotal displacement;

said second water powered means associated with said first water powered means such that said second water powered means is only operable when said first water powered means has vertically displaced said lift seat to said fully elevated position; and control means for operating said first and second water powered means mounted proximate the lift seat to permit operation of said control means by an individual occupying the seat.

2. A lift apparatus according to claim 1 wherein:

said first water powered means is a primary hydraulic cylinder which is vertically mounted within said base for rotation about said pivot axis and which includes a piston rod which forms part of said lift arm assembly, and said second water powered means is a secondary hydraulic cylinder horizontally mounted within said base to effect limited rotation of said primary cylinder about said pivot axis.

3. A lift apparatus according to claim 2 wherein:

said primary cylinder includes:

a selectively configured piston have a circumferential, medial groove with an associated duct defined within said piston such that pressurized water supplied to said primary cylinder to upwardly displace said piston communicates with said groove; and a selectively positioned port in an outer cylinder wall which communicates with said piston groove when said piston is in its most upwardly displaced position; and a hydraulic feed line for powering the operation of said secondary cylinder is coupled to said selectively positioned wall port of said primary cylinder.

4. A lift apparatus according to claim 2 wherein said primary cylinder piston rod is rectangular in cross section to prevent unwanted pivotal displacement of said lift seat during vertical displacement.

5. A lift apparatus according to claim 2 wherein said secondary cylinder has two alternate mounting positions within said base such that when said secondary cylinder is mounted in the first mounting position, the secondary cylinder pivots the lift seat from said outside spa position to said over spa position in a clockwise direction, and such that when said secondary piston is mounted in the second mounting position, said secondary piston pivots said lift seat from said outside spa position to said over spa position in a counterclockwise direction.

6. A lift apparatus according to claim 1 further comprising a leg rest associated with said lift seat which telescopes outwardly therefrom to support the legs of a seat occupant during use of the lift apparatus.

7. A lift apparatus according to claim 1 further comprising a headrest and seat belt associated with said lift seat.

* * * * *